United States Patent [19]

Kraus et al.

[11] 4,375,346

[45] Mar. 1, 1983

[54] DIAPHRAGM PUMP

[75] Inventors: Menahem A. Kraus, Rehovot; Avinoam Livni, Haifa; Moshe A. Frommer, Rehovot, all of Israel

[73] Assignee: A. T. Ramot Plastics Ltd., Tel Aviv, Israel

[21] Appl. No.: 131,370

[22] Filed: Mar. 18, 1980

[30] Foreign Application Priority Data

Mar. 29, 1979 [IL] Israel ..... 56975

[51] Int. Cl.[3] ..... F04B 43/06; F04B 43/12; F04B 21/02

[52] U.S. Cl. ..... 417/388; 417/199 A; 417/205; 417/477; 417/571; 417/395

[58] Field of Search ..... 417/199 A, 200, 205, 417/244, 383, 385, 386, 387, 388, 395, 474, 475, 476, 477, 571, 389

[56] References Cited

U.S. PATENT DOCUMENTS

| | | | |
|---|---|---|---|
| 2,260,180 | 10/1941 | Herder | 417/571 |
| 2,578,746 | 12/1951 | Scherger et al. | 417/388 |
| 2,657,636 | 11/1953 | Schmidt | 417/395 X |
| 3,579,124 | 8/1971 | Adams | 417/477 |
| 3,612,727 | 10/1971 | Drake | 417/388 |
| 3,644,061 | 2/1972 | McFarlin | 417/199 A X |
| 3,723,030 | 3/1973 | Gelfand | 417/477 X |
| 3,775,030 | 11/1973 | Wanner | 417/388 |
| 4,116,589 | 9/1978 | Rishton | 417/389 X |

FOREIGN PATENT DOCUMENTS

| | | | |
|---|---|---|---|
| 2432045 | 1/1975 | Fed. Rep. of Germany | 417/383 |
| 641694 | 6/1962 | Italy | 417/383 |

*Primary Examiner*—Leonard E. Smith
*Attorney, Agent, or Firm*—Benjamin J. Barish

[57] ABSTRACT

A diaphragm pump is described comprising a reciprocated diaphragm for expanding and contracting a chamber communicating with a passageway connecting the housing inlet and outlet for pumping a fluid therethrough, and a pair of check valves in the passageway permitting the fluid to flow only from the inlet to the outlet. The check valves are disposed along laterally-spaced parallel axes and provide a forward fluid flow through both valves in the same direction along the laterally-spaced parallel axes, the outlet of one check valve communicating with the inlet of the other via a folded section of the passageway having two 180° bends. Such an arrangement enables the diaphragm pump to be constructed in compact and/or miniaturized form.

According to another described feature, the diaphragm pump is constructed in combination with the peristaltic pump having an inlet for a liquid to be pumped, and an outlet connected to the inlet of the diaphragm pump. Both pumps are driven by a common drive shaft.

4 Claims, 3 Drawing Figures

DIAPHRAGM PUMP

BACKGROUND OF THE INVENTION

The present invention relates to diaphragm pumps for pumping fluids. The invention is particularly applicable to a hydraulic-type diaphragm pump for pumping a liquid, and is therefore described below with respect to this application.

Many constructions of diaphragm pumps are known. Generally, such pumps include a diaphragm reciprocated by a drive for expanding and contracting a chamber for pumping the fluid, and a pair of check valves permitting the fluid to flow only in the direction of the inlet to the outlet by the reciprocation of the diaphragm. The known diaphragm pumps, however, are usually of fairly large construction. Moreover, when used for pumping a liquid, the priming operation, i.e. initially filling the pump with the liquid, is frequently rather difficult because of the compressability of the air initially within the pump.

BRIEF SUMMARY OF THE INVENTION

According to one aspect of the present invention, there is provided a diaphragm pump comprising a housing having an upper housing section and a lower housing section secured together at one of their ends with a diaphragm supported therebetween.

The upper housing sections include a rotatable drive shaft, a cam driven thereby, a cylinder, a piston reciprocated within the cylinder by the cam, and a cover disc closing the coupled end of the upper housing section. The cover disc is formed with an inwardly-dished outer face facing the diaphragm, and with a bore establishing communication between the dished outer face and the outer end of the cylinder.

The lower housing section includes an inlet and an outlet for the fluid to be pumped, a fluid passageway connecting the inlet to the outlet, and a pumping chamber communicating with the latter passageway, which latter chamber is expanded and contracted by the reciprocation of the diaphragm, effected by the reciprocation of the piston, for pumping the fluid through the passageway. The lower housing section further includes a pair of check valves in the passageway permitting the fluid to flow only from the inlet to the outlet by reciprocation of the diaphragm. The check valves are disposed along laterally-spaced parallel axes and provide a forward fluid flow through both valves in the same direction along the laterally-spaced parallel axes. The outlet of one check valve communicates with the inlet of the other check valve via a folded section of the passageway having two 180° bends.

The lower housing section further includes a further cover disc closing its secured end, which further cover disc is formed with an inwardly-dished outer face facing the diaphragm and defining therewith the pumping chamber expanded and contracted by the reciprocation of the diaphragm. The latter cover disc is further formed with a bore establishing communication between the pumping chamber and the folded section of the passageway between the paid of check valves.

In the preferred embodiment of the invention described below, the reciprocated diaphragm and the valve seats of both check valves are disposed in substantially parallel spaced planes. More particularly, in the described embodiment the valve seats of both check valves are substantially coplanar; also, the diaphragm and the displaceable valve members of the check valves are disposed within the housing such that in use, the diaphragm is oriented in the horizontal plane and is reciprocated vertically, and the valve members are displaced vertically by the reciprocation of the diaphragm.

The foregoing features enable diaphragm pumps to be constructed in compact and/or miniaturized form.

According to a further feature, the diaphragm pump may be constructed in combination with a peristaltic pump having an inlet for a liquid to be pumped, and an outlet connected to the inlet of the diaphragm pump.

In the preferred embodiments described below, the peristaltic pump section and the diaphragm pump section are both driven by a common drive shaft. Preferably, as in one described embodiment, the peristaltic pump is selectively de-coupleable from the common drive shaft to permit operating the peristaltic pump section for priming the diaphragm pump section only.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
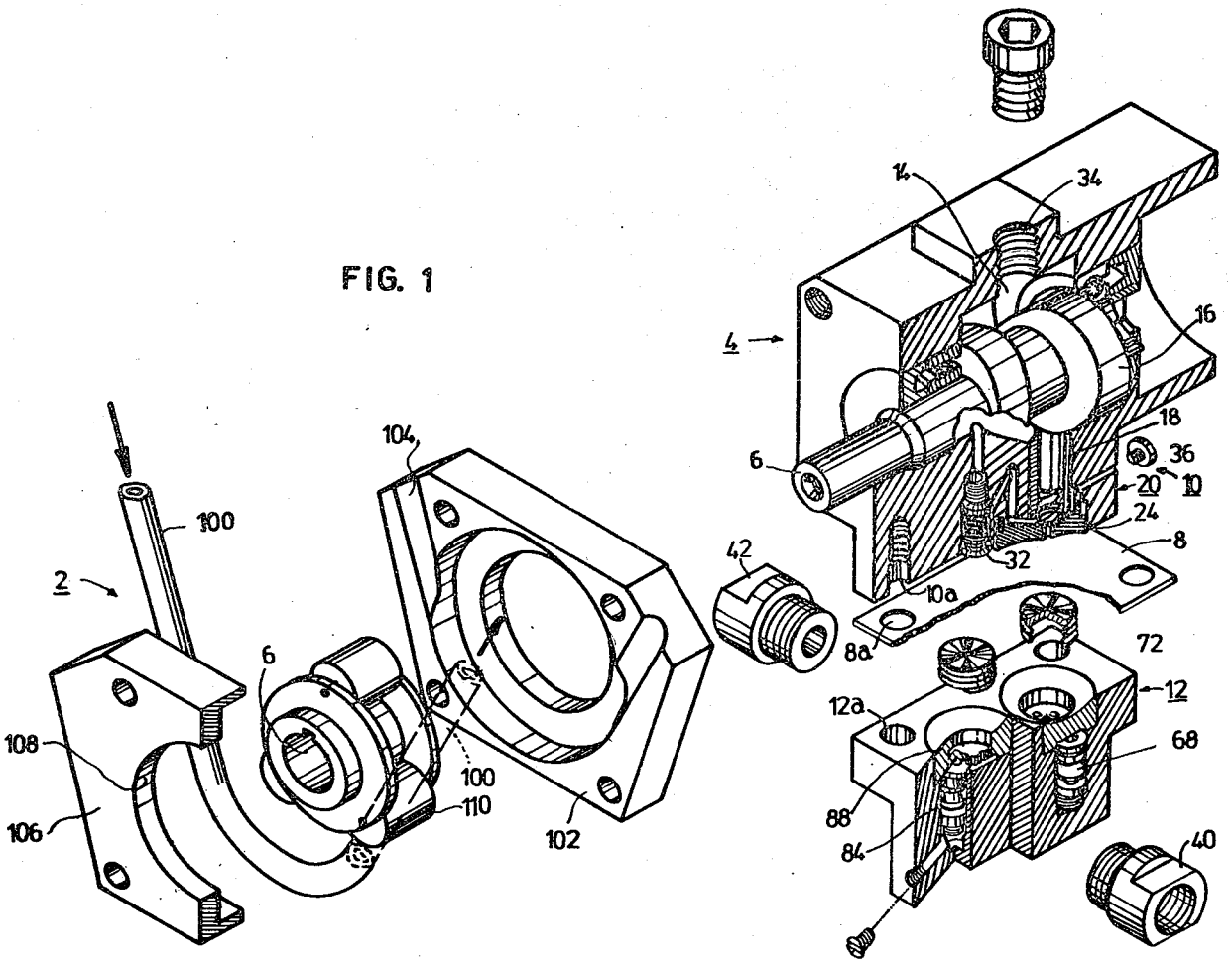
FIG. 1 is an exploded three-dimensional view of one form of diaphragm pump constructed in accordance with the invention, some parts being shown in section and other parts being omitted for purposes of clarity.

The hydraulic pump illustrated in FIG. 1 of the drawings comprises two main sections, namely: a peristaltic pump section, generally designated 2; and a diaphragm pump section, generally designated 4. Both sections are driven by a common drive shaft 6, which in turn is driven by a motor (not shown).

The diaphragm pump section 4 includes a diaphragm 8 disposed between two housing sections 10 and 12, all having aligned apertures 8*a*, 10*a*, 12*a*, adapted to receive fasteners for securing them together. During use, the diaphragm pump is oriented as illustrated in FIG. 1, namely with the diaphragm 8 disposed in a horizontal plane, and the two housing sections 10 and 12 disposed on opposite sides of the diaphragm.

The common drive shaft 6 passes through an opening in the upper housing section 10 into a cylindrical chamber 14 formed within that housing section. A cam 16 is fixed to drive shaft 6 within chamber 14 and is rotated by the drive shaft. Cam 16 bears against a plunger 18 to reciprocate it within a vertical cylinder 20 carried by housing section 10 for expanding and contracting a chamber 22 (see FIG. 2) defined by the lower face of plunger 18 within cylinder 20 and a cover disc 24 received within a recess in the lower face of housing section 10. The upper face of cover disc 24, defining one side of chamber 22, is dished, and the lower face of the cover disc is also dished to define another chamber 26 between it and diaphragm 8. In addition, cover disc 24 is formed with a through-going bore 28 to provide communication between chambers 22 and 26. The cover disc 24 is frictionally received within the recess at the lower face of housing section 10, and is sealed with respect thereto by an annular seal 30.

During use, chambers 14, 22, and 26 are all filled with hydraulic fluid. The reciprocation of plunger 18 by cam 16, carried by the rotary drive shaft 6, pressurizes and de-pressurizes the hydraulic fluid within chamber 26. This reciprocates the diaphragm 8 to pump a fluid through the lower housing section 12, as will be described more particularly below.

The upper housing section 10 further includes a ball check-valve 32 between a bore 33 and chamber 22. Bore 33 communicates with chamber 14 which serves as a reservoir for the hydraulic fluid. Check-valve 32 is oriented so as to permit the hydraulic fluid to flow into chamber 22 via bores 33, 33', but not in the reverse direction, so as to continuously replenish chamber 22 with the hydraulic liquid. Chamber 14 may be refilled via port 34.

The upper housing section 10 is further provided with a bore 35 communicating with the upper end of chamber 22 to bleed that chamber of any air accumulated therein. Bore 35 is manually opened when desired by a manually rotatable bleeding valve 36.

Figure 2:
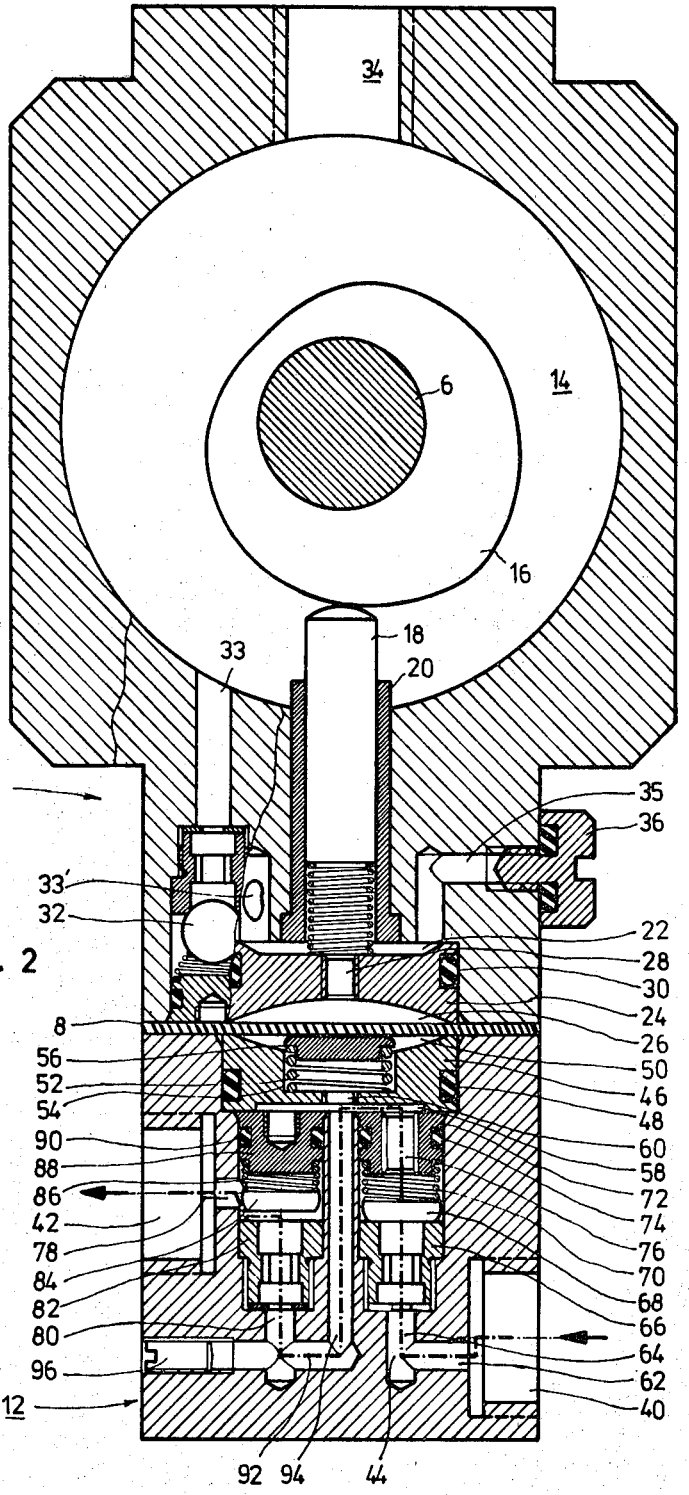
FIG. 2 is a sectional view illustrating the diaphragm section of the pump of FIG. 1.

The lower housing section 12 is formed with an inlet 40 for the fluid to be pumped, an outlet 42, and a connecting passageway, generally designated 44, for the fluid pumped from the inlet 40 to the outlet 42. The pump illustrated in FIGS. 1 and 2 is particularly useful for pumping water from inlet 40 to the outlet 42.

The upper end of the lower housing section 12 is recessed and frictionally receives a cover disc 46 (FIG. 2) which is similar to cover disc 24 received in the lower end of the upper housing section 10 and includes a similar annular seal 48. The face of cover disc 46 adjacent to diaphragm 8 is similarly dished, as cover disc 24, to define a pumping chamber 50 between it and the lower face of diaphragm 8, which chamber is expanded and contracted by the reciprocation of the diaphragm caused by the pressurizing and de-pressurizing of chamber 26 at the upper side of the diaphragm. The lower face of the diaphragm is spring-urged towards chamber 26 by means of a coil spring 52 received within a cylindrical socket 54 formed in the upper face of cover disc 46, the upper end of the spring carrying a cap 56 bearing against diaphragm 8.

The lower end of cover disc 46 is formed with a recess 58 which constitutes a part of the passageway 44 for the water pumped from inlet 40 to the outlet 42. In addition, cover disc 46 is further formed with a through-going bore 60 providing communication between water chamber 50 and recess 58 of the connecting passageway 44.

Connecting passageway 44 further includes a horizontal bore 62 leading from the water inlet 40, the opposite end of bore 62 communicating with a vertical bore 64 receiving a vertically-disposed valve seat 66. Valve seat 66 is adapted to be closed by a valve disc member 68 urged against the valve seat by a coil spring 70 interposed between the valve disc and a cap 72 frictionally received within the upper end of vertical bore 64. Valve cap 72 is provided with an annular seal 74 and with a center through-going bore 76 leading to recess 58 formed on the underface of cover disc 46.

At the outlet end 42, the lower housing section 12 is similarly formed with another horizontal bore 78 leading from the outlet 42 to a vertical bore 80 receiving a valve seat 82 cooperable with a valve disc 84. In this case, however, valve disc 84 underlies horizontal bore 78. It is spring-urged to its closed position against valve seat 82 by a coil spring 86 interposed between the valve disc and a cap 88 frictionally-received within the upper end of vertical bore 80 and sealed with respect thereto by an annular seal 90.

The lower end of vertical bore 80 communicates with a horizontal bore 92, which in turn communicates with the lower end of a vertical bore 94. The latter bore is formed in the housing section 12 between vertical bore 64 containing valve seat 66 and vertical bore 80 containing valve seat 82. The upper end of vertical bore 94 passes through the upper face of housing section 12 and communicates with the recess 58 formed in the lower face of cover disc 46.

Valve disc 68 spring-urged against valve seat 66, and valve disc 84 spring-urged against valve seat 82, both serve the functions of check valves in the passageway, generally designated 44, and control the water to flow only in the forward direction, i.e., from the water inlet 40 to the water outlet 42.

The diaphragm-driven section 4 of the pump illustrated in FIGS. 1 and 2 operates in the following manner:

As drive shaft 6 is rotated, its cam 16 reciprocates plunger 18 to pressurize and de-pressurize hydraulic chamber 26 and thereby to reciprocate diaphragm 8. The reciprocation of the diaphragm expands and contracts the water chamber 50 to pump the water from the water inlet 40 to the water outlet 42 via the interconnecting passageway 44. Thus, as chamber 50 is contracted by diaphragm 8, the water pressure is applied to close the check valve 68, and to open the check valve 84; and as chamber 50 is expanded by diaphragm 8, the water suction opens the check valve 68 and closes the check valve 84. It will thus be seen that both check valves are alternately opened and closed to permit the water to flow only in one direction, namely from inlet 40 to outlet 42, via the interconnecting passageway 44.

It will also be seen that this interconnecting passageway 44 includes a folded section having two 180° bends, namely: a first 180° bend constituted by bore 76 through valve cap 72, recess 58 in the lower face of cover disc 46, and the upper end of vertical bore 94; and a second 180° bend constituted by the lower end of vertical bore 94, horizontal bore 92, and the upper end of vertical bore 80. It will be further noted that the valve seats 66 and 82 of the two check valves are substantially coplanar and lie in a horizontal plane parallel to but spaced from the horizontal plane of the reciprocating diaphragm 8 so that their valve discs 68 and 84, respectively, are movable along parallel, laterally-spaced axes.

The foregoing features enable the diaphragm section of the valve to take a very compact construction, which may be miniaturized.

As indicated above, ball-valve 32 serves as a check valve for replenishing the hydraulic chamber 26 which the hydraulic fluid from reservoir 14, and manual valve 36 provides a means for bleeding air from the upper end of the hydraulic chamber 22. For bleeding air from the water housing section 12, the horizontal bore 92 is extended to the outer face of the housing section and is closed by a screw 96 which may be opened for this purpose.

The peristaltic pump section 2 of the pump as illustrated in FIG. 1 is provided to facilitate priming of the diaphragm section 4 of the pump. Thus, the peristaltic pump section 2 includes a peristaltic tube 100 supported within a housing 102 attached to housing 10 of the diaphragm section of the pump. Housing 102 is formed with a semi-circular recess 104 for receiving the peristaltic tube 100, and is closed by a cover plate 106. The cover plate has a central aperture 108 receiving the common drive shaft 6 which also drives the diaphragm-section of the pump. In the peristaltic section 2 of the pump, drive shaft 6 carries a plurality of rollers 110 which are rotated by the drive shaft and roll along the outer face of the peristaltic tube 100 to pinch the tube against the semi-circular recess 104 of the housing 102, and thereby to pump the liquid (e.g. water) through the tube. In this case, drive shaft 6 would be driven counter-clockwise (as shown in FIG. 1), thereby pumping the liquid from the left end (constituting the inlet end) of the peristaltic tube, to the right end (constituting the outlet end) of the peristaltic tube. The latter (outlet) end is connected to the inlet 40 of the diaphragm section of the pump.

It will thus be seen that as drive shaft 6 is rotated (counter-clockwise, FIG. 1), it pumps the water through the peristaltic tube 100 to fill the diaphragm-section 4 of the pump (i.e. the lower housing section 12) with water. The rotation of the common drive shaft 6 also effects the reciprocation of the diaphragm 8, by the reciprocation of the plunger 18 as described above, to pump the water from the water inlet 40 to the water outlet 42.

Since peristaltic tubes (e.g., tube 100 in FIG. 1) have a relatively short life, it may be desirable to couple the peristaltic section 2 of the pump to the hydraulic section 4 only during the initial starting of the pump in order to facilitate priming the hydraulic section, and to de-couple the peristaltic section 2 from the hydraulic section during the normal operation of the pump in order to extend the useful life of the peristaltic tube 100. An arrangement enabling this is illustrated in the modification of FIG. 3.

Figure 3:
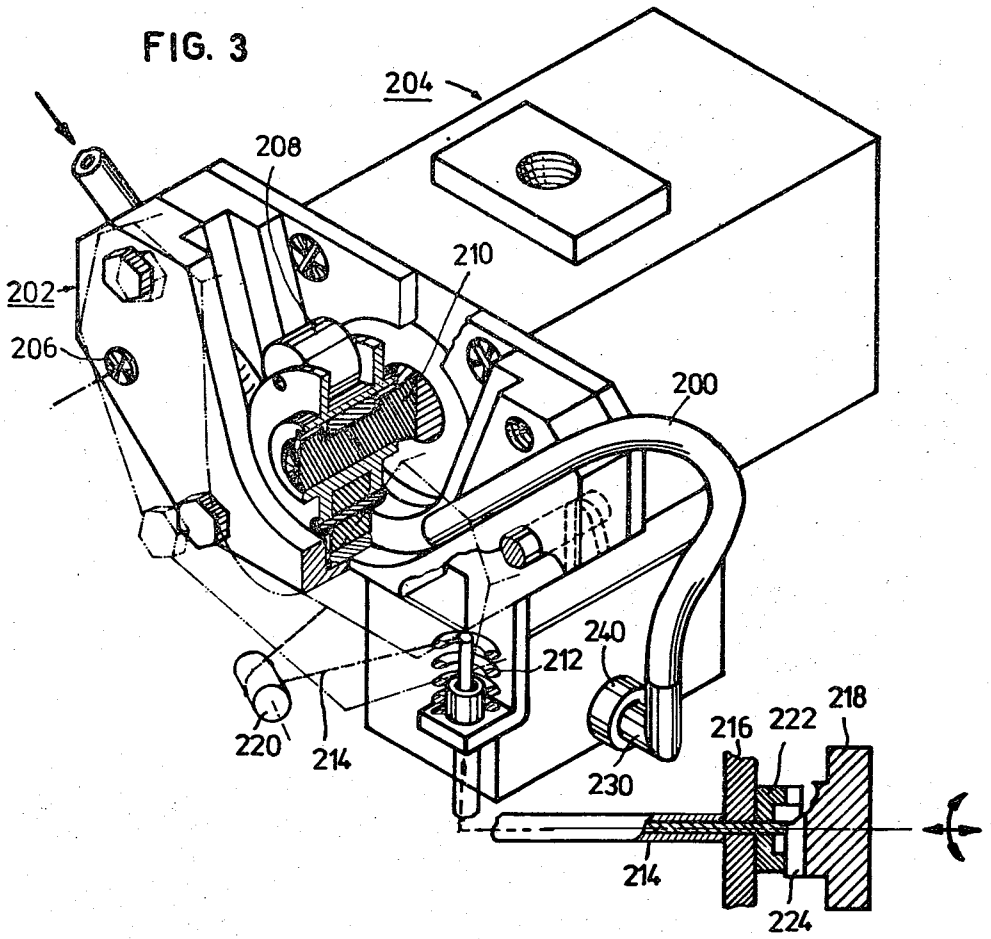
FIG. 3 is a three-dimensional view, with some parts shown in section, of another preferred form of diaphragm pump constructed in accordance with the invention.

The pump illustrated in FIG. 3 includes a peristaltic tube 200 carried by the peristaltic-pump section 202 which is pivotably mounted to the diaphragm-pump section 204 at pivot 206. The peristaltic-pump section 202 may thus be pivotted from the full-line position illustrated in FIG. 3, wherein the peristaltic tube 200 is engaged by the rollers 208 rotated by the common drive shaft 210, or to the broken-line position wherein the peristaltic tube 200 is spaced from the rollers 208.

The peristaltic-pump section 202 is urged by spring 212 to its operative (full-line) position but may be manually pivotted to its inoperative (broken-line) position by means of a cable 214 passing through an apertured panel 216 and having a manipulatable knob 218 at its outer end. The inner end of cable 214 is attached to the pivotable peristaltic-pump section 202 such that when the cable is pulled outwardly of apertured panel 216, the peristaltic pump section 202 is pivotted downwardly to its broken-line position. This arrangement is schematically shown in FIG. 3 by connecting the inner end of cable 214 to the bottom of the peristaltic-pump section 202 via a roller 220, so that pulling knob 218 outwardly causes the cable to pivot section 202 downwardly about pivot point 206.

For retaining the peristaltic-pump section 202 in either of its pivotted positions, the inner face of knob 218 and the outer face of a collar 222 secured to panel 216 are formed with stepped sections 224 and 226, respectively, facing each other, such that rotating knob 218 to one position (that illustrated in FIG. 3) causes its step 224 to engage the low surface of collar 222, and rotating the knob 180° causes the knob step 224 to engage the high surface 226 of collar 222.

The diaphragm-section 204 of the pump illustrated in FIG. 3 may be of the same construction as described with respect to FIGS. 1 and 2, and is driven by the common drive shaft 210 which also drives the peristaltic-pump section 202.

The pump illustrated in FIG. 3 operates as follows: For starting purposes, knob 218 is rotated to the position illustrated in FIG. 3, wherein its high step 224 seats in the low surface of step 226 formed in collar 222, whereby spring 212 urges the peristaltic-pump section 202 to its upper, full-line position; in this position, the peristaltic tube 200 is engaged by the rollers 208 rotated by the common drive shaft 210. Accordingly, as the drive shaft is rotated (clockwise), water is pumped from the inlet end (right end, FIG. 3) of the peristaltic tube 200 through its outlet 230, which outlet is connected to the inlet 240 of the diaphragm-section of the pump (corresponding to inlet 40 in FIGS. 1 and 2).

As soon as the peristaltic-pump section 202 has filled the diaphragm-pump section 204 with water, the operator may pull knob 218 outwardly and rotate it 180°, to seat its step 224 on the high surface of step 226 of collar 222, thereby pulling cable 214 outwardly. This causes the peristaltic-pump section 202 to pivot downwardly, against spring 212, to the broken-line position illustrated in FIG. 3, and moves the peristaltic tube 200 away from the drive rollers 208, thereby disabling the peristaltic-pump section. Accordingly, the continued rotation of the common drive shaft 210 will only drive the diaphragm section 204 of the pump and will not drive the peristaltic-section 202, thereby greatly extending the life of the peristaltic tube 200.

While the invention has been described with respect to two preferred embodiments, it will be appreciated that many other variations, modifications and applications of the invention may be made.

What is claimed is:

1. A diaphragm pump comprising a housing having an upper housing section and a lower housing section secured together at one of their ends; and a diaphragm supported between the secured ends of the housing sections; the upper housing sections including a rotatable drive shaft, a cam driven by said drive shaft, a cylinder, a piston reciprocated within said cylinder by said cam, and a cover disc closing the said secured end of said upper housing section; said cover disc being formed with an inwardly-dished outer face facing the diaphragm, and with a bore establishing communication between said dished outer face and the outer end of said cylinder; said lower housing section having an inlet for the fluid to be pumped, an outlet therefor, a fluid passageway connecting the inlet to the outlet, a pumping chamber communicating with said passageway which chamber is expanded and contracted by the reciprocation of said diaphragm effected by the reciprocation of said piston for pumping the fluid through said passageway, and a pair of check valves in said passageway permitting the fluid to flow only from the inlet to the outlet by the reciprocation of the diaphragm; said check valves being disposed along laterally-spaced parallel axes and providing a forward fluid flow through both valves in the same direction along the laterally-spaced parallel axes, the outlet of one check valve communicating with the inlet of the other check valve via a folded section of the passageway having two 180° bends; said lower housing section including a further cover disc closing the said secured end of the lower housing section, which further cover disc is formed with an inwardly-dished outer face facing the diaphragm and defining therewith said pumping chamber; said further cover disc being formed with a socket centrally of said inwardly-dished face and including a spring disposed within said socket urging the diaphragm in the return direction; said further cover disc being further formed with a recess underlying said socket and constituting a portion of the folded section of said passageway at a location between said pair of check valves, and a bore leading from said socket to said recess and thereby establishing communication between said pumping chamber and said folded section of said passageway.

2. A pump according to claim 1, wherein said upper housing section further includes a reservoir for the hydraulic fluid, and a further check valve for replenishing the hydraulic chamber with the hydraulic fluid.

3. A pump according to claim 1, wherein said upper housing section further includes a hydraulic chamber within which said drive shaft and cam rotate and communicating with said cylinder and piston, and a bleeding valve communicating with the upper end of the hydraulic chamber for bleeding air therefrom.

4. A pump according to claim 1, wherein said lower housing section includes a bleeding valve communicating with the lower end of the folded section of the fluid passageway between the two check valves therein.

* * * * *